US006223389B1

(12) United States Patent
Walsh et al.

(10) Patent No.: US 6,223,389 B1
(45) Date of Patent: May 1, 2001

(54) CURTAIN TAB CARRIER

(75) Inventors: Michael J. Walsh, Elm Grove, WI (US); William J. Schwartz, Rockford, IL (US); Ronald G. Hurth, Beaver Dam; John W. Grosz, Columbus, both of WI (US); Walter K. Saylor, Colon, MI (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/252,387

(22) Filed: Feb. 18, 1999

(51) Int. Cl.[7] ..... A47H 13/00; A47H 15/00

(52) U.S. Cl. ..... 16/87.4 R; 16/87.2; 16/95 D; 16/96 D

(58) Field of Search ..... 16/87.2, 87.4 R, 16/93 D, 94 D, 95 D, 96 D; 160/330, 345

(56) References Cited

U.S. PATENT DOCUMENTS

| | | | | |
|---|---|---|---|---|
| 2,706,827 | | 4/1955 | Lindner . | |
| 3,314,100 | | 4/1967 | Znamirowski . | |
| 3,342,247 | | 9/1967 | Graber et al. . | |
| 3,370,819 | | 2/1968 | Kenney . | |
| 3,881,217 | * | 5/1975 | Bytheway, Jr. | 16/87.2 |
| 3,881,218 | | 5/1975 | Palmer . | |
| 3,951,195 | | 4/1976 | Salzmann . | |
| 4,581,788 | * | 4/1986 | Baumann | 16/93 D |
| 4,881,588 | * | 11/1989 | Mdsen | 160/345 |
| 5,903,957 | * | 5/1999 | Le Manchee | 16/87.2 |

* cited by examiner

*Primary Examiner*—Chuck Y. Mah
(74) *Attorney, Agent, or Firm*—Foley & Lardner

(57) ABSTRACT

A curtain tab carrier assembly includes a rod having a pair of vertical flanges that form a channel therebetween. A guide is configured to slidably engage the pair of flanges along the channel. A carrier is secured to the guide and includes a base having a catch formed therein. A loop extends from the base over the rod. The curtain tab is positioned over the loop and is retained by a fabric retaining clip. The clip is hinged to the base and includes a locking tab formed therein. The locking tab engages the catch when the clip is in a closed position.

20 Claims, 4 Drawing Sheets

FIG. 5
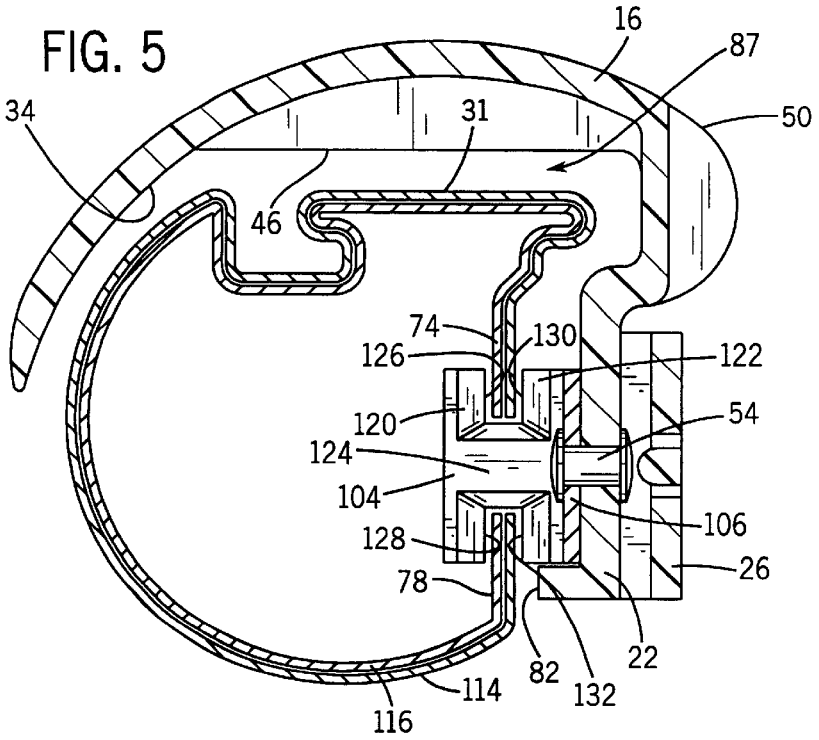
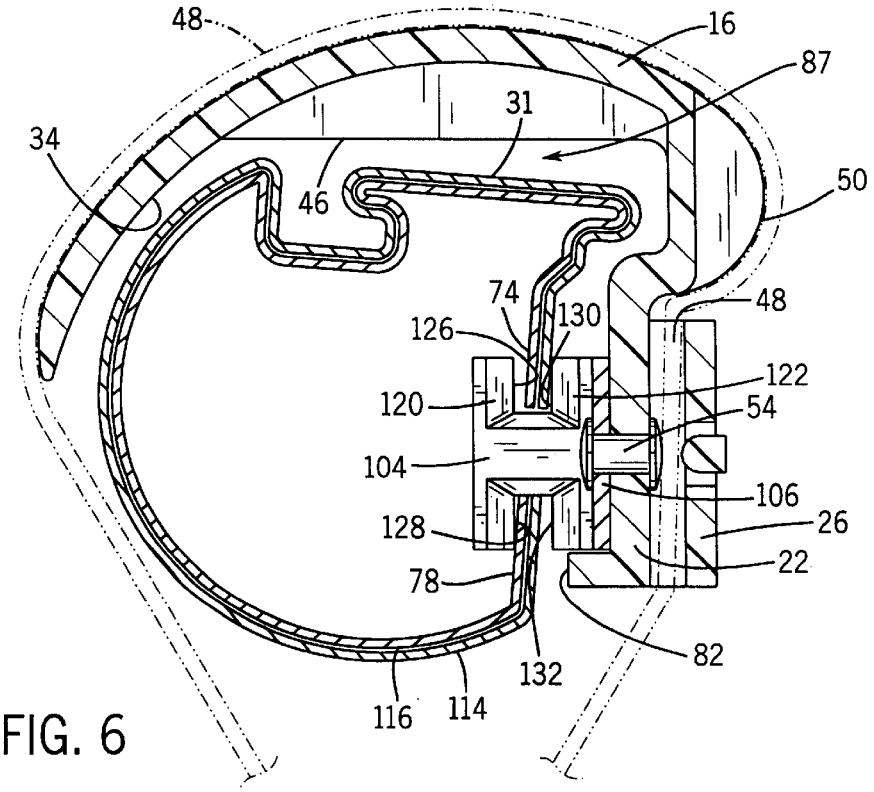
FIG. 6

CURTAIN TAB CARRIER

FIELD OF THE INVENTION

The present invention relates generally to a curtain carrier configured for use with a traverse rod. More particularly, the present invention relates to a curtain carrier that includes a fabric retaining mechanism for securing a curtain tab to a guide that slides along a track formed in the traverse rod.

BACKGROUND OF THE INVENTION

In general, traverse rods and carrier assemblies for curtain suspension mechanisms for use with traverse rods are well-known. Traverse rods offer the convenience of a pull cord or a baton draw to open and close the curtains. The prior art carrier assemblies include curtain support sliding elements which are configured to slide inside a track formed in the traverse rod. The curtain carrier assemblies are often in the form of "C"-shaped rings which wrap around the front of the rod. Attached to each of the rings is a downwardly projecting link which includes a hole to receive a standard curtain hook. This curtain hook suspension system is not easily adapted for use with other types of curtains such as tab curtains. Another problem exists in that there is not any "standard" for tab dimensions to ensure that a single suspension system will support curtains with differently-sized tabs. Therefore, it is difficult to configure traverse rods to suspend tab curtains.

In the prior art, tab curtains are usually suspended with metal curtain rods or wood poles which do not have any type of pull cords or baton draws, thereby relegating tab curtains to be used almost exclusively as decorative panels. Thus, consumers must grab the edge of the curtain and drag it across the metal curtain rod or wood pole. In the case of a metal rod, there is an exposed edge where the telescoping sections of the rod meet. When the edge of the curtain is pulled across this exposed edge, the curtain is often stopped and damaged.

It is therefore desirable to provide a curtain tab carrier which is configured for use with a standard traverse rod. Additionally, it is desirable to provide a carrier designed to accommodate different curtain tab dimensions. Finally, it is desirable to provide a fabric retaining mechanism which easily secures and releases the curtain tabs.

SUMMARY OF THE INVENTION

A curtain tab carrier assembly in accordance with one aspect of the present invention comprises a rod which includes a top portion and a channel. The assembly further comprises a carrier which includes a guide configured to slidably engage the channel, a loop member extending over the top portion of the rod, and a fabric retaining mechanism.

In accordance with another aspect of the present invention, a method for suspending a curtain having a tab comprises the steps of sliding a guide onto a rod including a top portion and a channel, placing an end of the rod through an opening of the tab and positioning the tab over a loop extending over the top portion of the rod. The loop extends from a carrier and the carrier includes a fabric retaining mechanism. The method of the present invention further comprises the step of retaining a portion of the tab top within the fabric retaining mechanism.

Yet another aspect of the present invention is a curtain tab carrier assembly comprising a rod including a top portion and a channel, and a fabric carrier including a guide configured to slidably engage the channel, support means extending over the top portion of the rod for supporting a curtain tab, and retaining means for retaining a portion of the tab.

Other principal features and advantages of the invention will become apparent to those skilled in the art upon review of the following drawings, the detailed description and the appended claims.

BRIEF DESCRIPTION OF THE DRAWINGS

The preferred exemplary embodiment of the invention will hereinafter be described in conjunction with the appended drawings, wherein like numerals denote like elements and:

FIG. 5 is a cross-sectional view taken generally along line 5—5 of FIG. 3;

FIG. 6 is the cross-sectional view of FIG. 5 including the curtain tab retained by the carrier assembly;

DETAILED DESCRIPTION OF A PREFERRED EXEMPLARY EMBODIMENT

Figure 1:
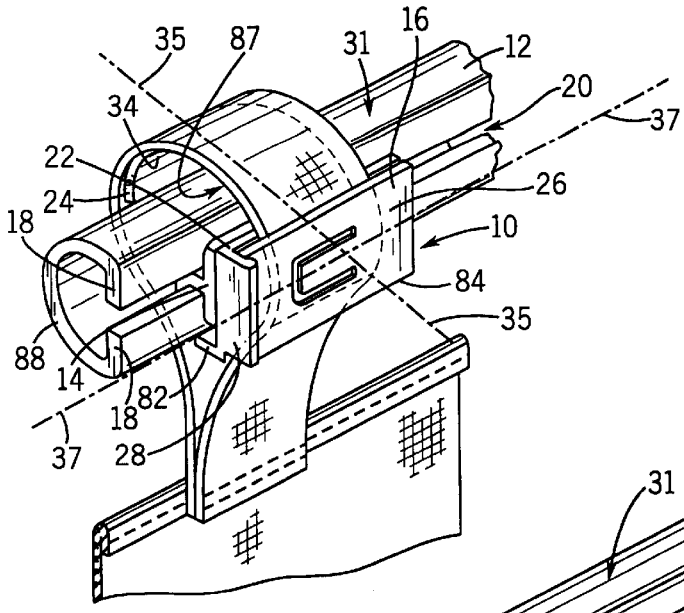
FIG. 1 is a back view of the carrier assembly in a closed position supporting a curtain tab.
Figure 2:
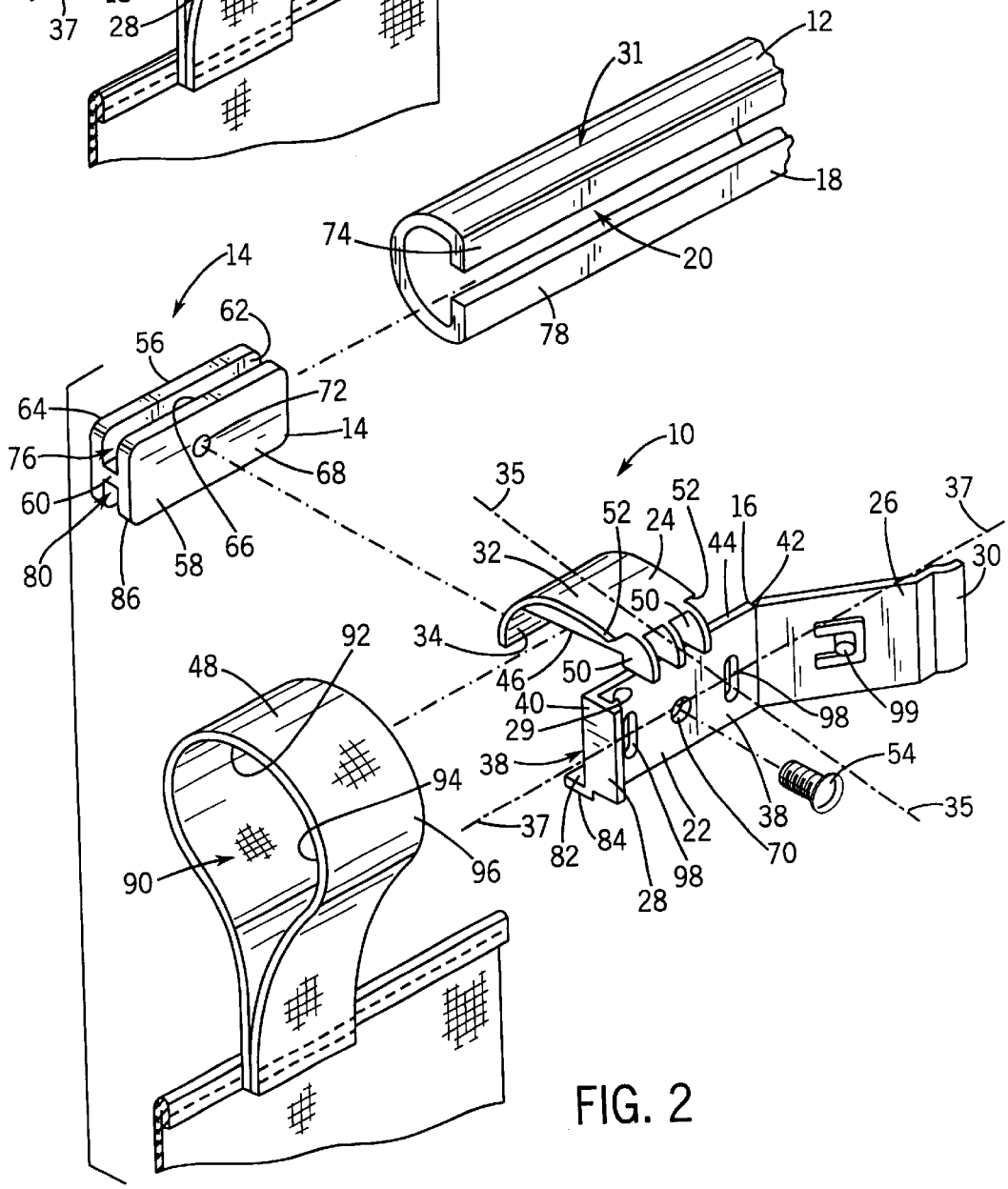
FIG. 2 is an exploded view of the carrier assembly mounted on a traverse rod of FIG. 1, with the carrier assembly in an open position.

Referring generally to FIGS. 1 and 2, a detailed description of an exemplary curtain tab carrier assembly 10 in accordance with the present invention will be described. Assembly 10 includes a rod 12, a guide 14 and a carrier 16. Rod 12 includes a pair of vertical flanges 18 forming a channel 20 therebetween. Guide 14 is configured to slidably engage flanges 18 along channel 20. Carrier 16 is secured to guide 14 and includes a base 22, a loop 24 and a fabric retaining clip 26.

Base 22 of carrier 16 has a catch 28 formed therein which is configured to interlock with a locking tab 30. Locking tab 30 is a rectangular arc which extends outwardly from clip 26. In the preferred embodiment of the present invention, clip 26 is hinged to base 22 and is secured in a closed position by snapping tab 30 behind a lip 29 formed in catch 28. "C"-shaped loop 24 of carrier 16 extends from base 22 and partially wraps around a top portion 31 of rod 12. Alternatively, instead of clip 26 being hinged and molded with base 22, base 22 and fabric retaining clip 26 can be a two-piece unit having built-in snaps and barbs to secure the back of a curtain tab from movement or clip 26 can be a separate connecting element made of metal, plastic, cloth or other material.

As shown in FIG. 2, loop 24 has a generally rectangular outer face 32 and a generally rectangular inner face 34. A longitudinal axis 35 of loop 24 is perpendicular to a longitudinal axis 37 of base 22. Base 22 includes a generally rectangular outer face 36 and a generally rectangular inner face 38. In the preferred embodiment of the present invention, the width of outer face 32 of loop 24 is smaller than the length of inner face 38 of base 22 to accommodate a range of curtain tabs. In particular, the present invention supports tabs between the dimensions of the width of outer face 32 of loop 24 and the length of inner face 38 of base 22. In addition to outer face 36 and inner face 38, base 22 has a first end wall 40, a second end wall 42 opposite first end wall 40, and a top wall 44 formed therebetween.

As described above, catch 28 extends generally perpendicular to first end wall 40 and clip 26 is hinged to second end wall 42 and configured to move between the closed position and an open position. Loop 24 extends from top wall 44 over base 22 and away from clip 26 when clip 26 is in the closed position. Loop 24 further includes at least one reinforcement rib 46 in order to support loop 24 under the weight of the fabric from curtain tab 48. Rib 46 is formed on inner face 34 of loop 24 and extends generally parallel to longitudinal axis 35 of loop 24. To further reinforce the rigidity of loop 24, loop 24 has supports 50 which form a bridge between top wall 44 and an end wall 52 of loop 24. Supports 50 are generally parallel to longitudinal axis 35 of loop 24.

Guide 14 includes a first plate 56, a second plate 58 and a bridge plate 60 formed therebetween. First plate 56 includes an inner face 62 and an outer face 64. Similarly, second plate 58 includes an inner face 66 and an outer face 68. As bridge plate 60 rides along channel 20, plate 60 is maintained in a position perpendicular to flanges 18 by inner faces 62 and 66 restricting horizontal movement relative to flanges 18.

Carrier 16 is secured to guide 14 with a rivet 54 which is press fit through an aperture 70 formed in base 22. Rivet 54 is also press fit through an aperture 72 formed in second plate 58 of guide 14. In such a configuration, outer face 36 of base 22 abuts outer face 68 of second plate 58 of guide 14. In the alternative, other securing devices may be used to secure carrier 16 to guide 14 including a threaded screw or a pin.

In operation, carrier 16, fastened to guide 14, is positioned into channel 20 so that a first flange 74 is received in a first cavity 76 formed between bridge plate 60, inner face 62 of first plate 56 and inner face 66 of second plate 58. Similarly, a second flange 78 is received in a second cavity 80 formed between bridge plate 60, inner face 62 of first plate 56 and inner face 66 of second plate 58.

Additional stabilization is provided by a gliding ledge 82 formed along a bottom wall 84 of base 22 opposite top wall 44. Ledge 82 traverses the length of outer face 36 of base 22 and frictionally engages a bottom surface 86 of second plate 58 of guide 14. Ledge 82, reinforcement rib 46 and supports 50 ensure a cavity 87 formed between the rod 12 and inner surface 34 of loop 24 is maintained even under the weight of curtain tab 48 resting on outer face 32 of loop 24.

An end 88 of rod 12 is placed through a generally circular opening 90 of curtain tab 48 so that an inside upper surface 92 of tab 48 covers outer face 32 of loop 24. In the closed position, fabric retaining clip 26 frictionally engages an inside surface 94 and an outside surface 96 of tab 48. A pair of slots 98 formed in base 22 provide clearance for rivet rolls when carrier 16 is fastened to guide 14. A rounded boss 99 formed on the inside surface of clip 26 adjacent to base 22 provides an extension to reach thinner fabric tabs and hold them in place. Thicker curtain tabs will cause clip 26 to be pressed outward, but clip 26 will still be exerting pressure through rounded boss 99 to the thicker curtain tabs.

Figure 3:
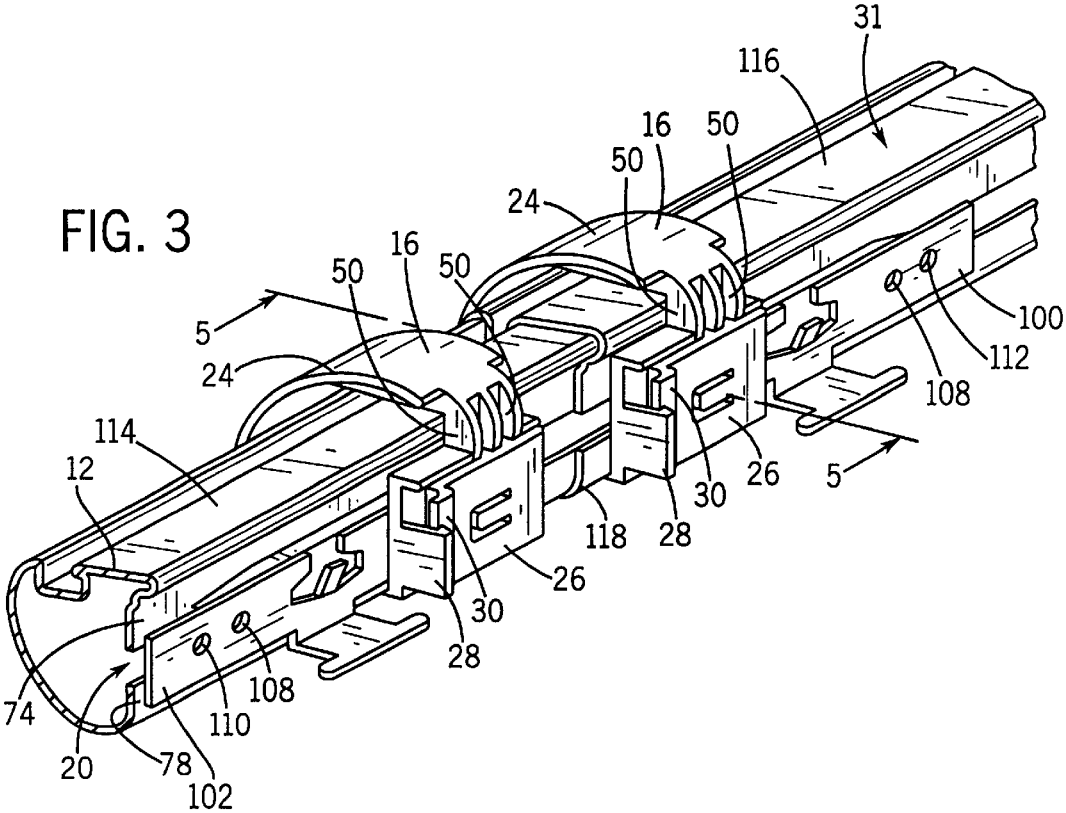
FIG. 3 is an isometric view of the traverse rod including the carrier assembly with right and left master end guides.
Figure 4:
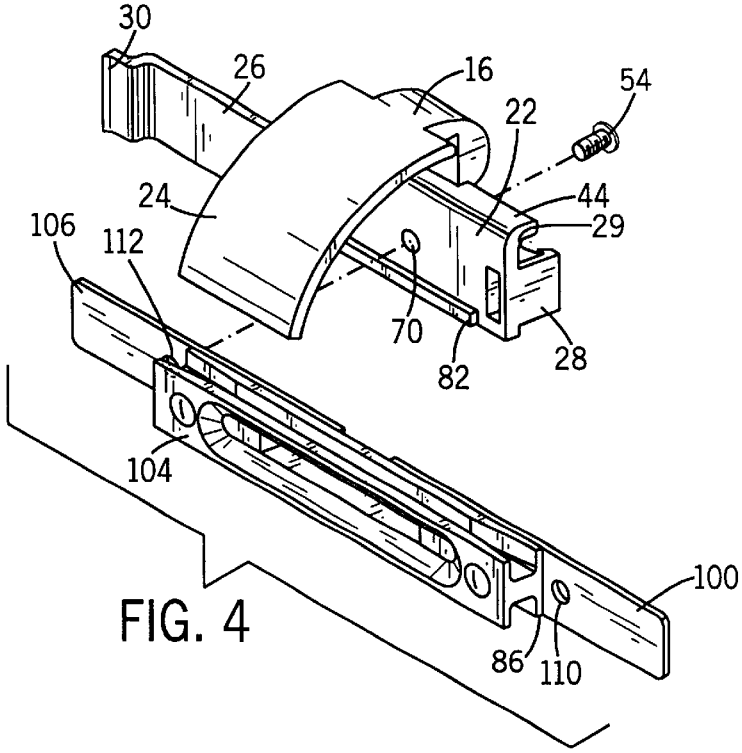
FIG. 4 is an exploded view of the carrier assembly and master end guides of FIG. 3, with the carrier assembly in an open position.

Referring to FIGS. 3 and 4, a right master end guide 100 and a left master end guide 102 are configured to engage rod 12 along channel 20. Master end guides 100 and 102 include a master carrier guide 104 which is riveted to a universal master plate 106 through apertures 108. Universal master plate 106 includes a first mounting aperture 110 and a second mounting aperture 112 which are configured to receive rivet 54 for attachment of carrier 16 to universal master plate 106. Apertures 110 and 112 are adjacent to apertures 108. Carrier 16 can be secured to either side of right end guide 100 or left end guide 102 through first or second apertures 110 or 112, respectively.

As illustrated in FIGS. 3 and 5, rod 12 consists of telescoping portions 114 and 116. Portion 116 slidably receives portion 114 such that the diameter of an end 118 of portion 116 is larger than the diameter of portion 114. Master carrier guide 104 includes a first plate 120, a second plate 122 and a bridge plate 124 formed therebetween. First plate 120 includes an upper inner surface 126 and a lower inner surface 128. Similarly, second plate 122 includes an upper inner surface 130 and a lower inner surface 132. Without the weight of a curtain, first flange 74 is generally centered between upper inner surfaces 126 and 130, while second flange 78 is generally centered between lower inner surfaces 128 and 132. However, when tab 48 is placed over loop 24 and held in place between base 22 and fabric retaining clip 26, first flange 74 is in frictional contact with upper inner surface 130 of second plate 122 and second flange 78 is in frictional contact with lower inner surface 128 of first plate 120 (FIG. 6). In order to minimize the resistance or drag produced by the contact between flanges 74 and 78 and surfaces 130 and 128, respectively, inner face 34 of loop 24 is maintained at a distance from rod 12 (cavity 87) even under the weight of tab 48. As discussed above, ledge 82, reinforcement rib 46 and supports 50 limit the movement of inner face 34 of loop 24 towards rod 12 when carrier assembly 10 supports tab 48.

Figure 7:
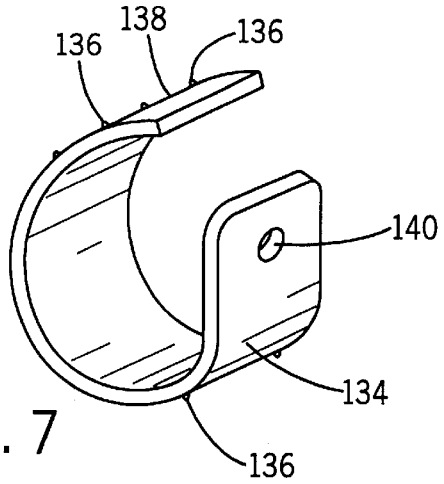
FIG. 7 is side view of an alternative embodiment of the loop member of the present invention.

FIG. 7 illustrates an alternative embodiment of the present invention which includes a loop 134 having a plurality of barbs 136 formed on an outer face 138 of loop member 134. Loop member 134 is secured to guide 14 with a rivet press fit through an aperture 140. Tab 48 is positioned over loop member 134 and held in place with barbs 136.

Figure 8:
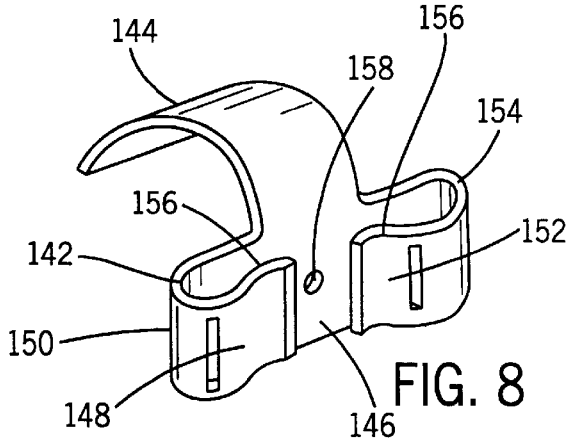
FIG. 8 is a back view of an alternative embodiment of the carrier assembly of the present invention.
Figure 9:
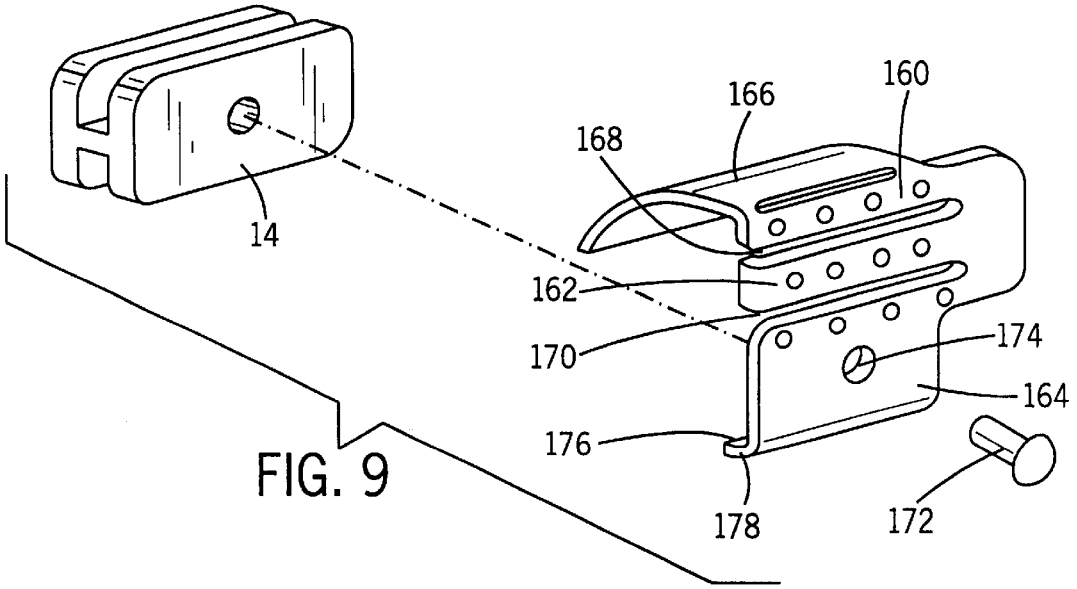
FIG. 9 is an exploded view of an alternative embodiment of the carrier assembly of the present invention.

FIGS. 8–9 illustrate alternative embodiments of the carrier mechanisms of the present invention. Referring to FIG. 8, a S-shaped clip 142 includes a loop member 144, a base 146, a first end wall 148 extending from a first end 150 of base 146 and a second end wall 152 extending from a second end 154 of base 146 opposite first end wall 148. A portion 156 of first and second end walls 148 and 152 frictionally engage base 146. Tab 48 is positioned over loop member 144 and held in place between portion 156 of first and second end walls 148 and 152 and base 146. In the alternative, first end wall 148 and second end wall 152 may be perpendicular to ends 150 and 154, respectively. Clip 142 is secured to guide 14 with a rivet press fit through an aperture 158.

Referring to FIG. 9, a clip 160 includes a prong 162, a base 164 and a loop 166. Prong 162 is adjacent to a first slot 168 and a second slot 170. A rivet 172 is press fit through aperture 174 to secure clip 160 to guide 14. An anti-rotation ledge 176 is formed along a bottom edge 178 of base 164 to stabilize clip 160 when tab 48 is positioned over loop 166 and through slots 168 and 170. Anti-rotation ledge 176 frictionally engages bottom surface 86 of second plate 58 of guide 14.

While the present invention has been described with certain Figures representing a particularly preferred embodiment, the invention is not to be limited thereby but is to be limited solely by the scope of the claims which follow.

What is claimed is:

1. A curtain tab carrier assembly to support a tab top curtain having at least one tab, comprising:

a rod including, a top portion and a channel; and a carrier including a guide configured to slidably engage the channel, a loop member to support the at least one tab, the loop member and the at least one tab member extending over the top portion of the rod, and a fabric retaining mechanism.

2. The curtain tab carrier assembly of claim 1, wherein the fabric retaining mechanism includes a catch formed on a base and a fabric retaining clip hinged to the base and having a locking tab formed therein.

3. The curtain tab carrier assembly of claim 2, wherein the locking tab engages the catch when the clip is in a closed position.

4. The curtain tab carrier assembly of claim 1, wherein the fabric retaining mechanism includes a first end wall extending from a first end of a base and a second end wall extending from a second end of the base opposite the first end wall.

5. The curtain tab carrier assembly of claim 4, wherein the first and second end walls are S-shaped.

6. The curtain tab carrier assembly of claim 5, wherein a portion of the first and second end walls frictionally engages the base.

7. The curtain tab carrier assembly of claim 1, wherein the fabric retaining mechanism includes a clip and an anti-rotation ledge formed along a bottom edge of a base.

8. The curtain tab carrier assembly of claim 1, wherein the loop member is semi-circular.

9. The curtain tab carrier assembly of claim 1, wherein the loop includes a predetermined width extending parallel to a longitudinal axis of the rod; a base including a predetermined base width extending parallel to the longitudinal axis of the rod, the predetermined base width being greater than the predetermined width of the loop smaller than the length of the base.

10. The curtain tab carrier assembly of claim 1, wherein the loop member includes a plurality of barbs formed on an outer face of the loop member.

11. A method for suspending a curtain having a tab, comprising the steps of:

sliding a guide onto a rod including a top portion and a channel;

placing an end of the rod through an opening of the tab;

positioning the tab over a loop extending over the top portion of the rod and from a carrier, the carrier including a fabric retaining mechanism; and retaining a portion of the tab within the fabric retaining mechanism.

12. The method of claim 11, wherein the fabric retaining mechanism includes a catch formed on a base and a fabric retaining clip hinged to the base and having a locking tab formed therein.

13. The method of claim 12, wherein the step of retaining the portion of the tab includes capturing the portion of the tab between the base and the fabric retaining clip by pivoting the clip to a closed position and snapping the locking tab into the catch.

14. A curtain tab carrier assembly, comprising:

a rod including a top portion and a channel; and a fabric carrier including a guide configured to slidably engage the channel, support means extending over the top portion of the rod for supporting a curtain tab, and retaining means for retaining a portion of the tab.

15. The curtain tab carrier assembly of claim 14, wherein the support means includes a loop member.

16. The curtain tab carrier assembly of claim 14, wherein the retaining means includes a catch formed on a base and a fabric retaining clip hinged to the base and having a locking tab formed therein, the locking tab engaging the catch when the clip is in a closed position.

17. The curtain tab carrier assembly of claim 14, wherein the retaining means includes a first end wall extending from a first end of a base and a second end wall extending from a second end of the base opposite the first end wall.

18. The curtain tab carrier assembly of claim 17, wherein the first and second end walls are S-shaped.

19. The curtain tab carrier assembly of claim 18, wherein a portion of the first and second end walls frictionally engages the base.

20. A method for suspending a curtain having a tab, comprising the steps of:

sliding a guide onto a rod including a top portion and a channel;

placing an end of the rod through an opening of the tab; and positioning the tab over a loop extending from the guide and over the top portion of the rod.

* * * * *